US006494240B1

(12) United States Patent
Brisson

(10) Patent No.: US 6,494,240 B1
(45) Date of Patent: Dec. 17, 2002

(54) APPARATUS FOR CONTROLLED CURVED SAWING OR CUTTING OF TWO-FACED CANTS

(75) Inventor: Maurice Brisson, Laval (CA)

(73) Assignee: Denis Comact Inc., Québec (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/923,176

(22) Filed: Sep. 4, 1997

(51) Int. Cl.[7] ..... B27B 31/06; B26D 7/06

(52) U.S. Cl. ..... 144/357; 144/242.1; 144/378; 144/382; 83/75.5; 83/76.8; 83/364; 83/367

(58) Field of Search ..... 83/72, 74, 75.5, 83/76.8, 156, 360, 364, 367, 422, 425, 425.2, 425.3, 436.1, 436.15, 436.3, 436.6; 144/39, 341, 357, 373, 378, 382, 398, 2.1, 242.1, 246.1, 246.2, 248.6, 250.16

(56) References Cited

U.S. PATENT DOCUMENTS 261,728 A * 7/1882 King ..... 83/425.3
3,538,966 A * 11/1970 Collins ..... 144/2.1 X
3,960,188 A * 6/1976 Schmidt ..... 144/398 X
4,078,592 A * 3/1978 Standal ..... 144/246.1 X
4,144,782 A * 3/1979 Lindstrom ..... 83/425 X
4,383,561 A * 5/1983 Gregoire et al. ..... 144/357 X
4,548,247 A * 10/1985 Eklund ..... 144/357
5,148,847 A * 9/1992 Knerr ..... 144/357
5,243,888 A * 9/1993 Bowlin ..... 83/76.8
5,320,153 A * 6/1994 Knerr ..... 144/357
5,400,842 A * 3/1995 Brisson ..... 144/398
5,429,161 A * 7/1995 Allard ..... 144/357 X
5,435,361 A * 7/1995 Knerr ..... 144/378
5,907,986 A * 6/1999 Buchacher ..... 144/248.6 X
5,946,995 A * 9/1999 Michell et al. ..... 144/357 X
6,178,858 B1 * 1/2001 Knerr et al. ..... 83/76.8

* cited by examiner

*Primary Examiner*—Clark F. Dexter
(74) *Attorney, Agent, or Firm*—Orum & Roth

(57) ABSTRACT

In combination with a cant sawing or cutting unit, a system for guiding two-faced cants through the cut along the line of their natural curvature which includes at the infeed and outfeed ends of the unit, laterally moveable rollers for clamping upon parallel planar faces of the cant and imparting to it a pivotal movement in the horizontal plane while it is moving forward through the cut, so that the saws or cutters follow along a controlled curve in relation to the natural curvature of the cant.

8 Claims, 10 Drawing Sheets

APPARATUS FOR CONTROLLED CURVED SAWING OR CUTTING OF TWO-FACED CANTS

FIELD OF THE INVENTION

The present invention relates to an apparatus for causing a controlled curved sawing or cutting of two-faced cants.

BACKGROUND OF THE INVENTION

A two-faced cant is produced by removing from a log, either by sawing or chipping, an approximately equal volume from each side, after such log has been rotated in an angular position which places its natural curvature in a plane parallel to the two faces to be obtained in the process. Such cants are subsequently resawn perpendicularly to the cut faces to produce lumber of such dimensions as required in the marketplace.

While dimensional accuracy and edge straightness are requisites for this product, it has long been known that some bowing in a board across its thickness dimension, such as may occur in natural fiber stress relieving during the cut, is not detrimental to the quality of merchantable lumber since subsequent stacking and drying processes will straighten out any such curvature to a commercially acceptable degree.

In time, lumber producers have realized that straight line sawing along the length of a naturally curved two-faced cant could entail important losses in lumber yield. This led to a search for means to execute parallel curved cuts in a bowed workpiece, while preserving the thickness accuracy of every board produced. As long as cutting speeds were kept at low levels, simple ways including manual guiding were devised and used with some degree of success. However, during the past 20 years, sawing technology and market pressures have pushed feed rates beyond eight feet per second and new guiding methods for curved sawing had to be found.

Up to present times, most of the improved guiding systems which have been devised for this purpose still involve contact with the rough sides of the two-faced cants being processed. Even if such devices respond to the general curvature of the workpiece, surface deformities alter their perception of the basic shape of the piece. Besides, effective curve limiting in the cut is not possible because the guiding effect depends totally on contact with the natural surfaces of the piece, thus producing at times lumber that is bowed to such an extend as to cause problems in subsequent handling operations.

On the other hand, it is well known that, in making longitudinal cuts perpendicularly to the parallel planar faces of a two-faced cant, any angular misalignment of the feed rolls in contact with said planar faces will cause a deviation of the cut from a straight line. Angular misalignment in this context is considered as any departure from 90° in the angle between the axis of said feed rolls and the theoretical feed line, as viewed in the plane parallel to the planar faces of the cant. A previous development, such as described in applicant's U.S. Pat. No. 4,400,842, issued Mar. 28, 1995 to Brisson, has made use of this particularity basically by means of a pivotally mounted feed roll system which has variable orientation in the horizontal plane, thus exerting on the planar faces of the cant a lateral frictional force to cause a deviation of the workpiece during the cut. Since the intent of this development was to use a single guiding unit whether in the front or the back of the saws, it follows that a certain length of the cut, at one end or the other of the piece, is beyond curve control and remains straight. Also, the guiding action caused by the angular misalignment of feed rolls as described above, is dependent on friction factors which vary with the condition of the wood; in any situation, the actual deviation rate of the workpiece tends to be slow in relation to the total process cycling time of one to two seconds, depending on piece length and feed rate. This condition limits to a large extent reversed curve sawing in compound curvature cants.

OBJECTS OF THE INVENTION

It is an object of the present invention to provide a control system for the perpendicular resawing or facing of two-faced cants while following the longitudinal axis of their natural curvature in response to data obtained from a scanner upstream of the sawing or cutting unit.

Another object is to provide a control system for the perpendicular resawing or facing of two-faced cants through a guiding procedure which is entirely carried out by contact of mechanical components with the planar faces of the cant and therefore unaffected by any natural surface irregularities encountered on its rough sides.

A further object of the invention is to provide a curved sawing control system which is not influenced by any type of natural defects in a two-faced cant, thus eliminating the need for previous inspection and reject, while preventing undue saw stresses caused by sudden lateral feed line deviations which may occur in other systems using rough side contact for cant guidance.

Another object of the invention is to provide a system which can, for any condition of the cant, limit the degree of curving of the cut to whatever is deemed acceptable in sawn lumber with respect to subsequent handling and processing.

Another object is to provide a mechanical guide system for curved perpendicular resawing of two-faced cants which is mainly free of lateral slippage at the contact areas with the planar faces of the workpiece.

Another object is to provide a guiding system having definite lateral motion in either direction, such movements being controlled in speed and instantly reversible, thus allowing variable and compound curvatures of a cant to be reproduced in the cut, throughout the full length of the piece.

A further object is to provide a guiding system which causes a horizontally pivoting motion of the cant, about a vertical rotation axis whose preferred location, in or near the cut zone, can be selected by suitable design of control linkage components of the system.

Hence, one main object of this invention, which is to optimize lumber yield when resawing bowed cants, further requires that any movement of the guiding elements be computer programmed from a full form scan of the workpiece as it enters the system.

STATEMENT OF THE INVENTION

The present invention is concerned with a fast positively acting guiding system to be used in processing two-faced cants along the mean axis of their natural curvature, either in multiple resawing perpendicularly to the parallel planar faces, or in squaring off by means of a double facing canter. This is achieved by using laterally moveable infeed and ouffeed guiding units joined by a mechanical linkage and working with a longitudinally sawing or cutting unit which may be composed of saws or knife type cutterheads.

The purpose of this arrangement is to cause the workpiece (i.e. the two-faced cant) to follow, during its forward travel, a trajectory which will cause a suitable curving cut to be performed by the sawing or cutting unit. This result is accomplished by displacement, transversal to the feed axis, of preferably two moveable guiding units consisting of powered rollers clamping unto the horizontally parallel planar faces of the cant, in areas before and beyond the sawing or cutting unit, and continuously moving the cant laterally in opposite directions within those areas during its forward travel through the cut. These combined lateral motions are controlled in speed and direction by a computer interpretation of scanner data and they are further positionally interlocked by means of a control linkage connecting the two guiding units. The linkage effect, beyond insuring total motion synchronism, also establishes a fixed pivotal point for the workpiece, the location of which is determined by the geometry of the linkage itself. This latter feature of the system permits locating this pivotal point by design in the most favorable area to minimize lateral stresses to the cutting elements.

This preferred area lies between the cutting zone and the rotating axis of the saws or cutter heads so as to limit, on the one hand, lateral stresses on the cutting elements and, at the same time, keep any back rubbing of saw teeth or cutting knives at a practical minimum. It therefore becomes a matter of choice, within the scope of this invention, to locate the pivotal point for the workpiece somewhere between the cutting zone of the saw and its rotating axis, in order to reduce side thrust in said cutting zone and to strive at the same time towards equalizing side pressure on saw teeth in front and back. Both aims are worthwhile and can be reached with the present system, by adjustment of the workpiece pivotal point, through suitable proportioning of the linkage joining the two guiding units, as will be further explained in a detailed description of the diagram showing the general mechanical arrangements.

It is to be noted that, before entry to the processing unit (whether sawing or squaring), the cant must be prepositioned laterally and properly oriented in relation to the theoretical feed line. This is currently done in the industry by means of a number of infeed systems such as, for example, an apparatus commonly termed a "linear optimizer" and described in U.S. Pat. No. 5,429,161 to B. Allard of Jul. 4th, 1995.

Within the general concept of the present invention, curved sawing or cutting may be generated by three different methods of applications: by locating one guiding unit either before the cut or after the cut, or by using guiding units in both areas with a control linkage between the two. The main difference in results between these three options can be stated as follows: for a front location of the guiding unit, the latter part of the cut falls beyond its control and necessarily follows a straight line; for a rear location, the opposite occurs in that the first part of the cut is not affected by the guiding system and, therefore, is straight. In general terms, straight lengths of cut totalling approximately 2½ feet must be considered in either case, which means that the cut in an 8 foot log could only be curved for some 70% of its length, if only one guiding element were used. In the case of a system including a front and a rear mounted unit, suitably linked together, the total length of the cut may be curved if the computer solution demands it and the pivotal point of the cant can be maintained within the preferred area for most of the cut, whereby this pivotal point will remain ahead of the cutting zone in both cases where a single cant guiding unit is used.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

Figure 3A:
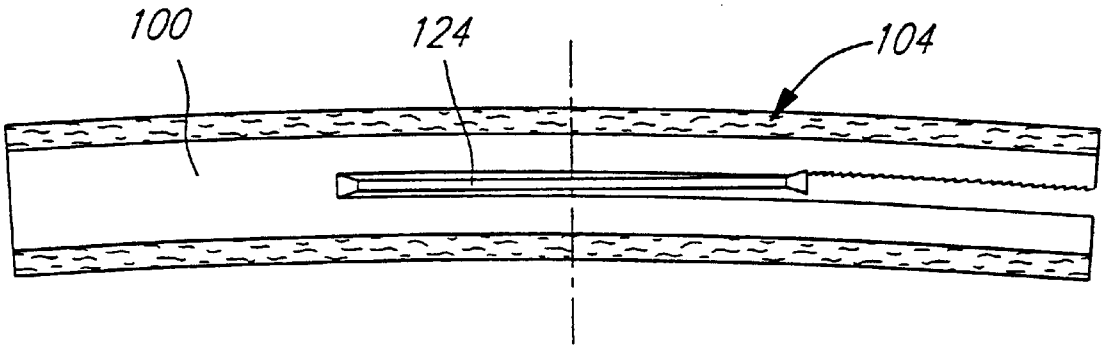
Figure 3B:
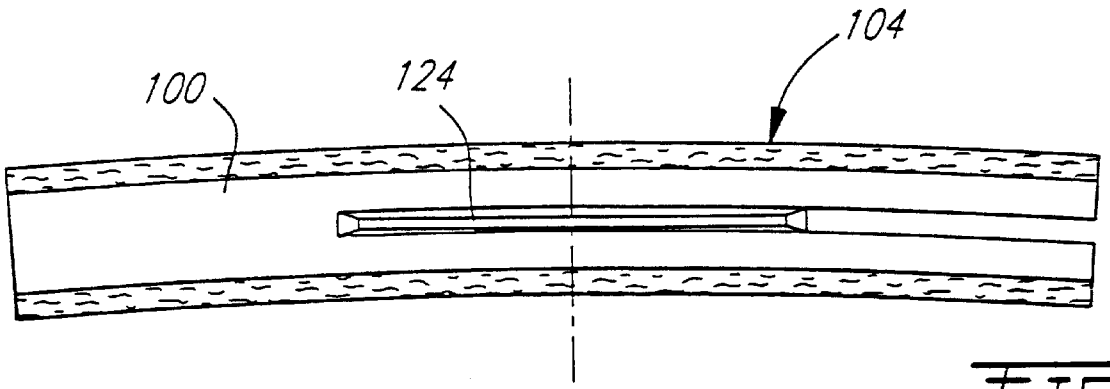
Figure 5:
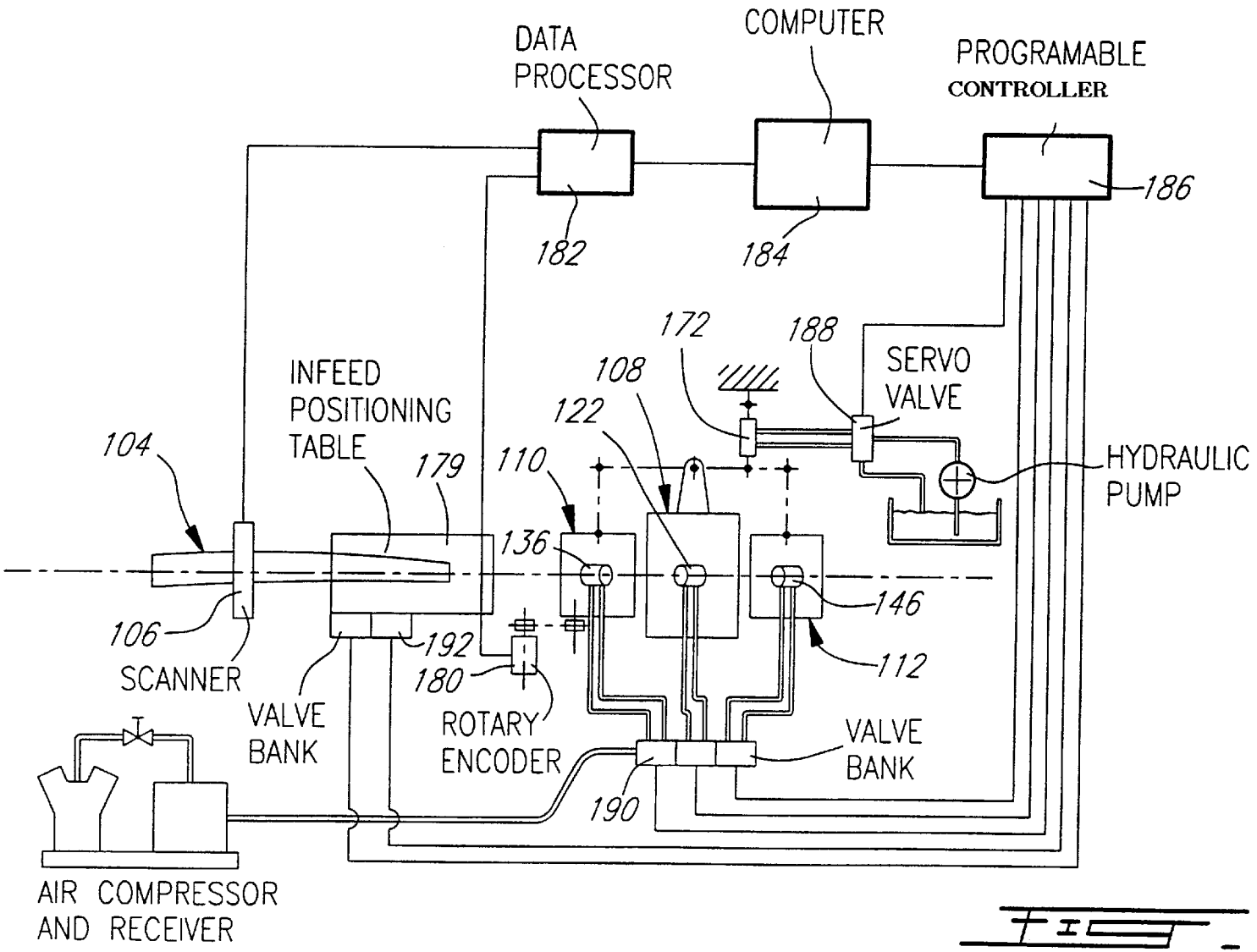
Figure 6:
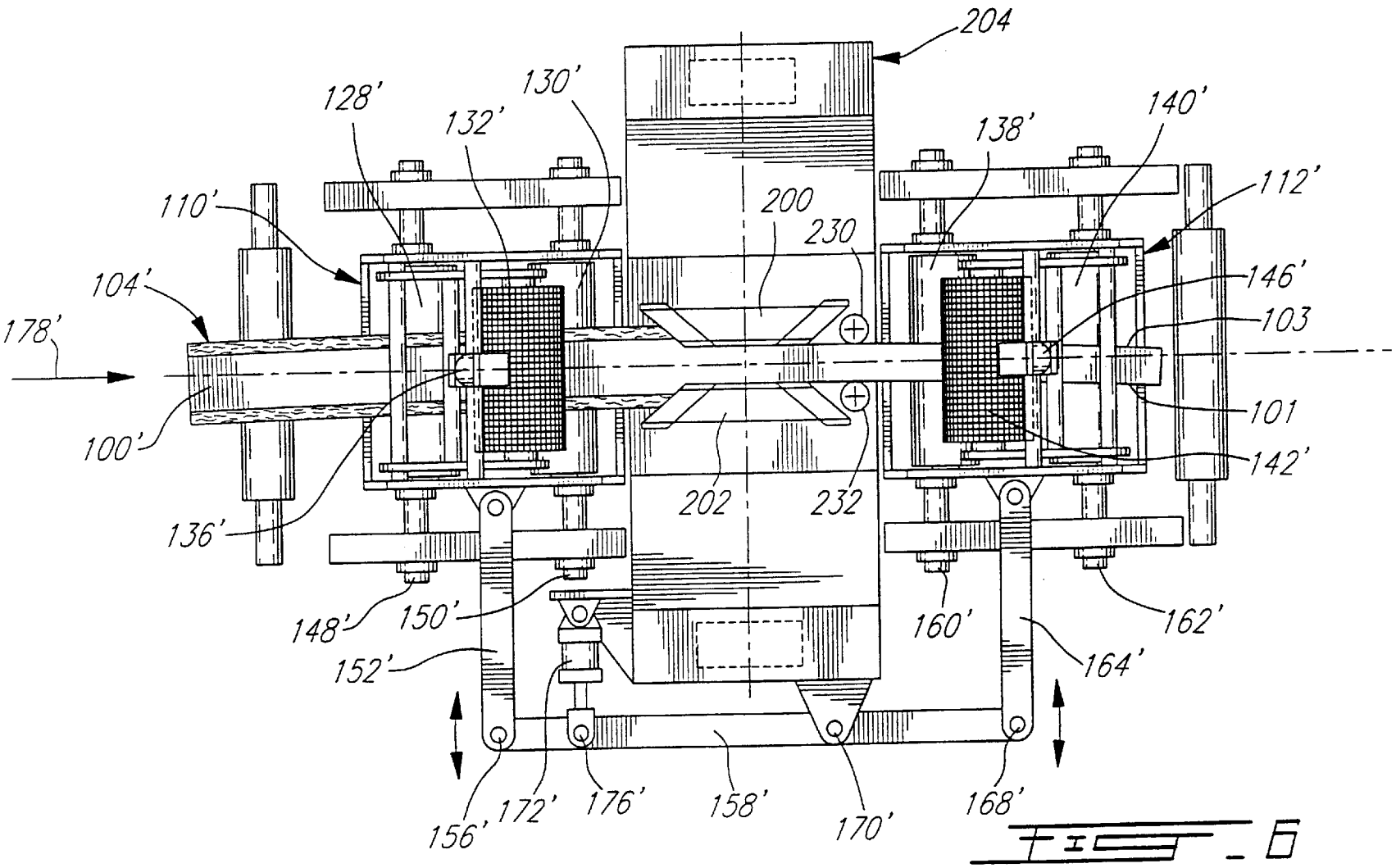

FIGS. 3*a* and 3*b* show two preferred tangential saw alignments;

FIGS. 4*a*, 4*b*, 4*c*, 4*d* and 4*e* show five steps of a curved sawing sequence;

FIG. 5 is a schematic diagram of a function and sequence control system; and FIG. 6 is a schematic top plan view of a cutting unit embodying the present invention.

Figure 7:
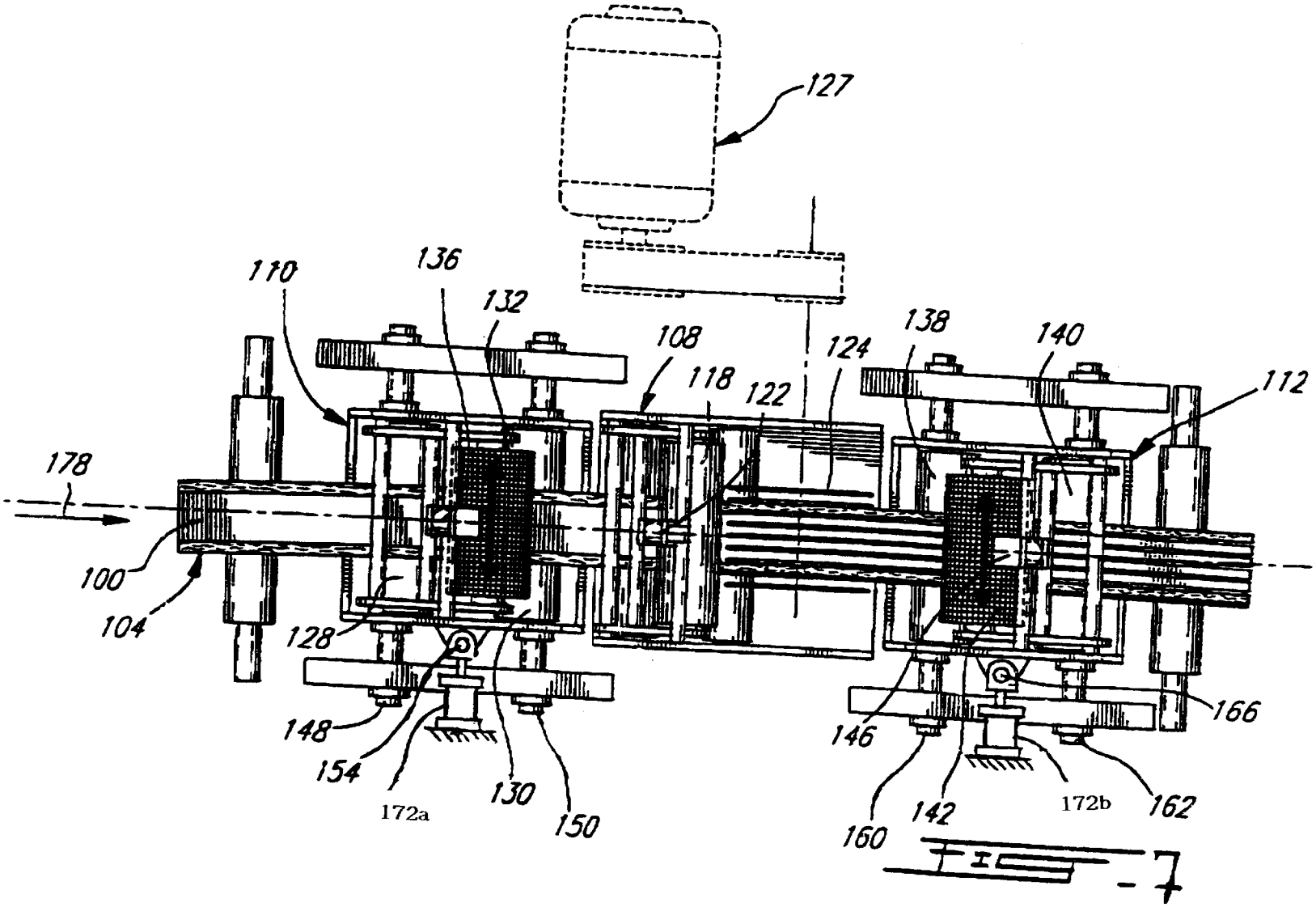

FIG. 7 is a schematic top plan view of a sawing unit embodying an alternate form of the invention.

Figure 8:
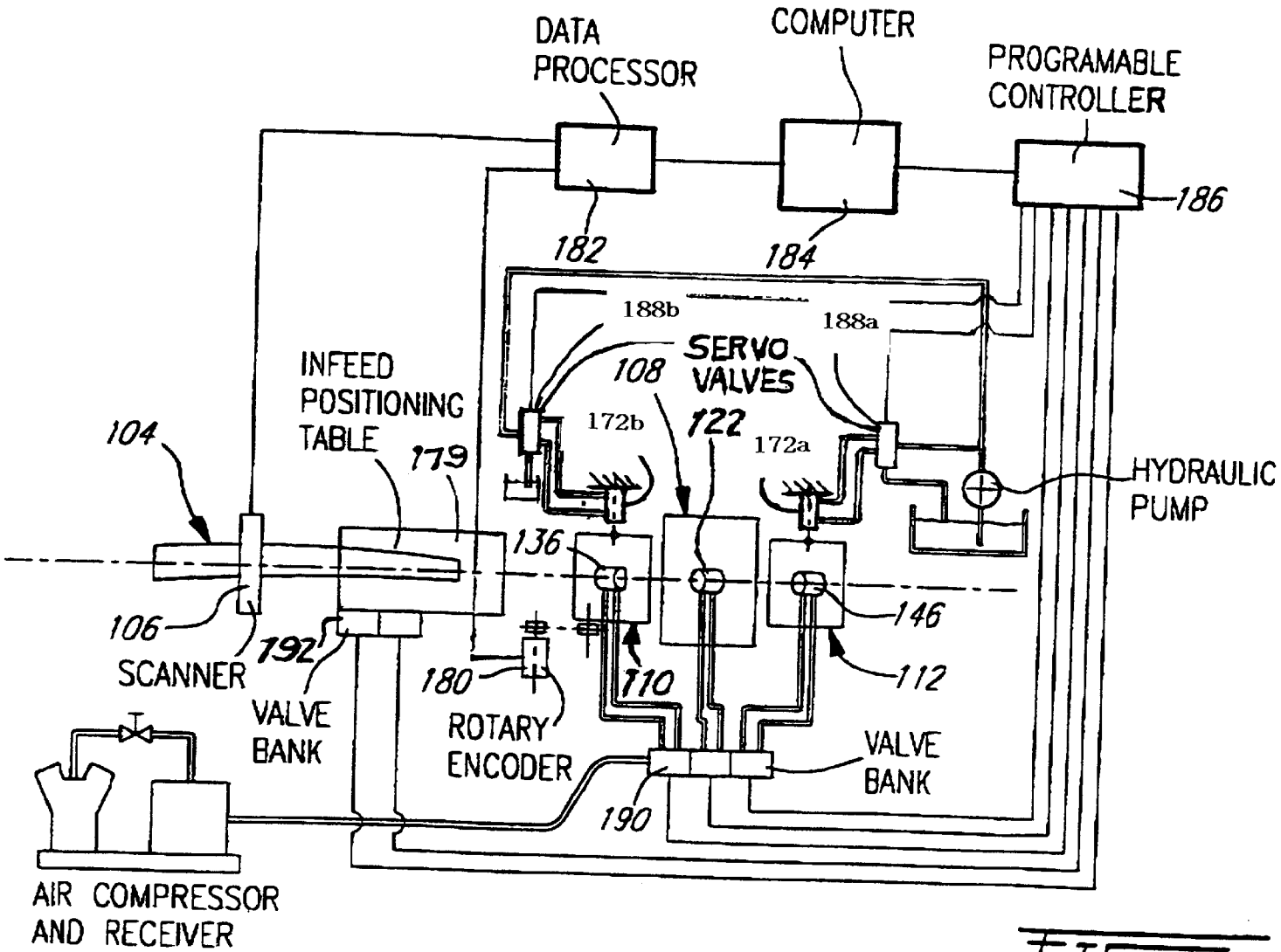

FIG. 8 is a schematic diagram of a function and sequence control system relating to the alternate form of the invention shown in FIG. 7.

DESCRIPTION OF PREFERRED EMBODIMENTS

The following is a description of the curved cutting control system of the present invention, comprising mechanical components, such as motorized rollers having contact solely with the planar faces 100, 102 of a two-faced cant 104 in order to guide it through either final resawing (FIGS. 1–4) or a squaring off process (FIG. 6), whether in a straight line or along the natural curvature of the piece, as determined by previous dimension and form readings by a scanner 106 (see FIG. 5).

Figure 1:
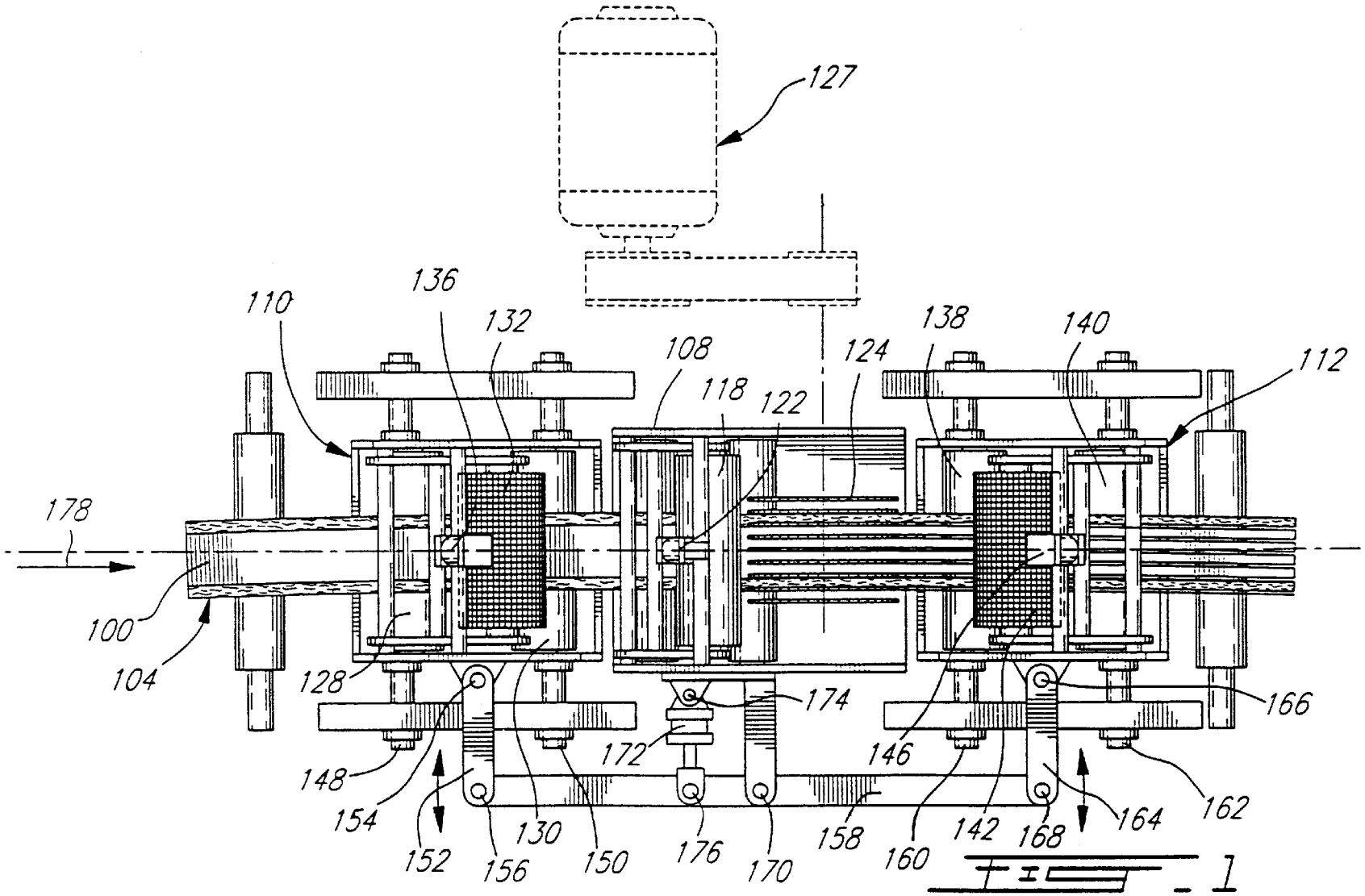
FIG. 1 is a schematic top plan view of a sawing unit embodying the present invention.
Figure 2:
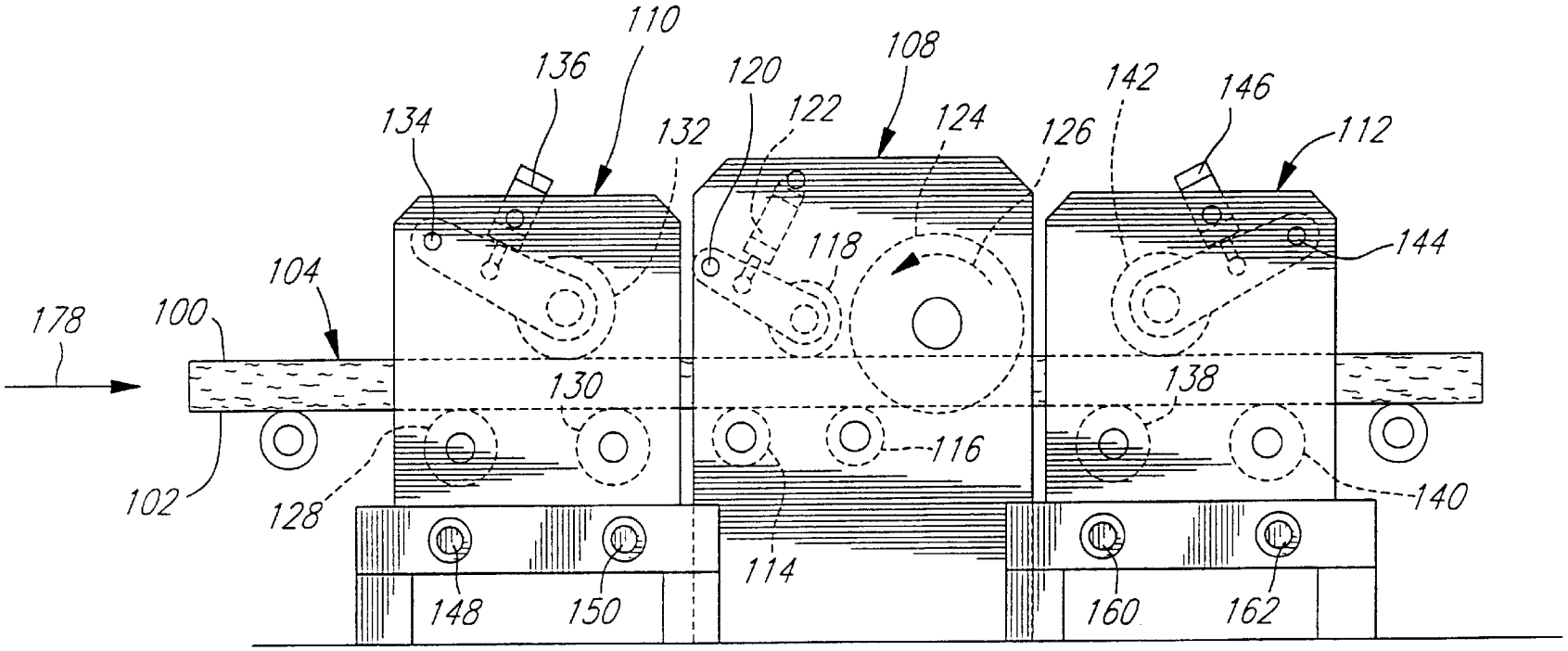
FIG. 2 is a schematic side elevational view thereof.

Referring more particularly to FIGS. 1 and 2, a cant resawing embodiment of the present invention is illustrated. Schematically, the embodiment comprises a processing unit 108 disposed between a pair of cant guiding units 110 and 112, respectively located upstream and downstream of unit 108. The latter comprises a pair of stationary lower rollers 114 and 116 and an upper roller 118 which may swing up or down about axis 120 by the action of a cylinder 122. The unit 108 also comprises a series of vertically disposed and horizontally spaced circular sawing blades 124 rotatable in the direction indicated by arrow 126 by means of a drive unit 127.

The first guiding unit 110 comprises a pair of supporting lower rollers 128 and 130 and an upper roller 132 which swings about an axis 134 under the action of a cylinder 136.

The second guiding unit 112 comprises a pair of supporting lower rollers 138 and 140 and an upper roller 142 which swings about an axis 144 under the action of a cylinder 146.

The first guiding unit 110 is laterally moveable along a pair of sideways 148, 150 under the action of a connecting lever 152 having one end 154 pivotally mounted to the unit frame 110 and the opposite end 156 pivotally connected to an equalizing lever 158.

The second guiding unit 112 is laterally displaceable along a pair of slideways 160,162 under the action of a connecting lever 164 having one end 166 pivotally mounted to the unit frame 112 and the opposite end 168 pivotally connected to the equalizing lever 158.

The equalizing lever 158 has a fixed pivot point 170 mounted on a firm base, such as the frame of unit 108. A controlling cylinder 172 has its opposite ends 174, 176 pivotally connected to the frame of unit 108 and the equalizing lever 158, respectively.

The operation of the cant resawing system will now be described. When a cant 104 moves towards the sawing unit 108, in the direction of arrow 178, it first passes through the first guiding unit 110 where it is clamped upon its two horizontal faces 100,102 through the action of the cylinder 136, between laterally moveable rollers 128,130 and 132. The cant then reaches stationary mounted rollers 114, 116 and 118 which will also close upon the horizontal faces 100, 102 and serve as a temporary pivotal point for the cant as guiding unit 110 begins to move laterally on slideways 148,150 to initiate the curving cut. After passing through the saws 124, the forward end of the cant reaches the second guiding unit 112 where rollers 138, 140 and 142 also close upon the horizontal faces 100, 102 while unit 112 is moving laterally on slideways 160,162 in the opposite direction to that of guiding unit 110, and in synchronism with it due to the action of an equalizing lever 158 which pivots about axis 170 and joins the two units through connecting levers 152 and 164. At this time, a geometric pivotal point is established for the cant by the interlinked opposite motions of guiding units 110 and 112. Stationary hold-down roll 118, being no longer required to provide a pivotal point, is lifted from the top face of the cant by the action of cylinder 122. The synchronized opposite motions of guiding units 110 and 112, being controlled by cylinder 172 through equalizing lever 158, cause the horizontally pivoting movement of the cant to continue, at this time around a vertical axis geometrically positioned in the preferred area, by the design location of pivot point 170 on equalizing lever 158.

The curved sawing continues after the trailing end of the cant has left guiding unit 110, whereupon press roll 132 lifts to admit the next incoming cant while stationary clamping roll 118 closes upon the top face 100 of the outgoing cant in order to maintain a pivotal point for it until the curved sawing is completed by the sideways motion of the rear guiding unit 112. Then press roll 142 also lifts off and both guiding units 110 and 112 return to their base position. Needless to say that, in order to perform straight line sawing, it is only necessary to leave the two guiding units 110 and 112 in a stationary position.

In the preferred embodiment of the invention, the basic functional control system as illustrated in FIG. 5, comprises the dimension and form scanner 106, a rotary encoder 180, a data processing unit 182, a computer 184, and a programable controller 186 which emits signals to a servo valve 188 and to solenoid actuated pneumatic valves 190 and 192.

These control elements are so programmed as to produce the correct sequential displacements of a positioning infeed device (linear optimizer) 179, guiding units 110 and 112, as well as required pressure application and release by rollers 132, 118 and 142 through their respective cylinders 136, 122 and 146. Furthermore, the control system functions according to a programmed sequence determined by the longitudinal position of the cant as monitored continuously since scanning, by the pulsation count of the rotary encoder 180. Generally, the above described functions of the guiding system are performed in relation to the position of the cant following its initial detection by the scanner of the leading and trailing ends of each cant, which triggers a count by the computer of the electrical impulses generated by the encoder. Since the encoder rotation is mechanically linked to that of the clamping rolls in guiding unit 110, the amount of impulses emitted and counted is a direct measure of the distance travelled by the cant from the point of detection.

Again, in relation with FIGS. 1 and 2, it can be further mentioned that the synchronizing linkage between guiding units 110 and 112, composed mainly of equalizing lever 158 pivoting around fixed point 170, is moved at controlled speeds by positioning cylinder 172 which, in turn, responds to computer commands through the servo-valve 188 in accordance with scanner data. The actual positioning of the guiding units is accomplished by the two connecting arms 152 and 164 which complete the control system. From the foregoing description of the process and the accompanying illustrations, it is easily inferred that the element which determines the curve radius of the cut is the speed of displacement of the guiding units 110 and 112 while the direction of such curve is determined by the direction of motion of these units.

It can also clearly be seen from the geometry of the linkage and its relation with the guiding units that, when a cant is directed laterally by the action of press down rollers 132 and 142, it must remain parallel to equalizing lever 158 and therefore retains a pivotal point along its length which is located opposite pivot point 170 along the length of the lever.

A word should be said at this point on the importance, when resawing along a curved line, to prevent or at least limit lateral motion of the workpiece in the cutting zone, so as to minimize side pressure on the saw teeth. This condition makes it necessary to maintain throughout the curving cut a pivotal point for the cant, to be positioned as closely as possible to the cutting area, whether in front or behind. A better understanding of this situation can be obtained by examining FIGS. 3*a* and 3*b* which show the two most favorable orientations of the curved cut line with the plane of the saw. Even in these preferred arrangements where the pivoting point for the cant would be, for FIG. 3*a*, in the cutting area and, for FIG. 3*b*, at the saw axis, it is easy to see that no lateral tooth clearance exists within the cut in either case. It follows that, in curved sawing, horizontal rotation of the cant from a pivotal axis located at some distance from the cutting area, could cause heavy side pressure on the saw teeth with possible heating and deformation of the saw. The system proposed in this invention allows this pivot point to be located at the closest possible distance in front of the saw during entry and exit of the cant (FIGS. 4*b* and 4*d*), and in any chosen location, in or near the cutting zone (as in FIG. 4*c*) for sawing the central part of the cant.

It should be noted that the synchronizing action of the proposed mechanical linkage 158, 152 and 164 between guiding units 110 and 112 could be performed by various other means such as causing a constant volume of fluid to be displaced within a closed loop system connected by cylinders to the guiding units or, instead, establishing a computer linkage between two actuating systems, as illustrated in FIGS. 7 and 8 each comprising a servo-valve 188*a*, 188*b* and cylinder 172*a*, 172*b* (identical to servo-valve 188 and positioning cylinder 172 in FIG. 5) and each being connected to one of the guiding units. The remaining components illustrated in FIGS. 7 and 8 are identical to those illustrated in FIGS. 1 and 5.

Figure 4A:
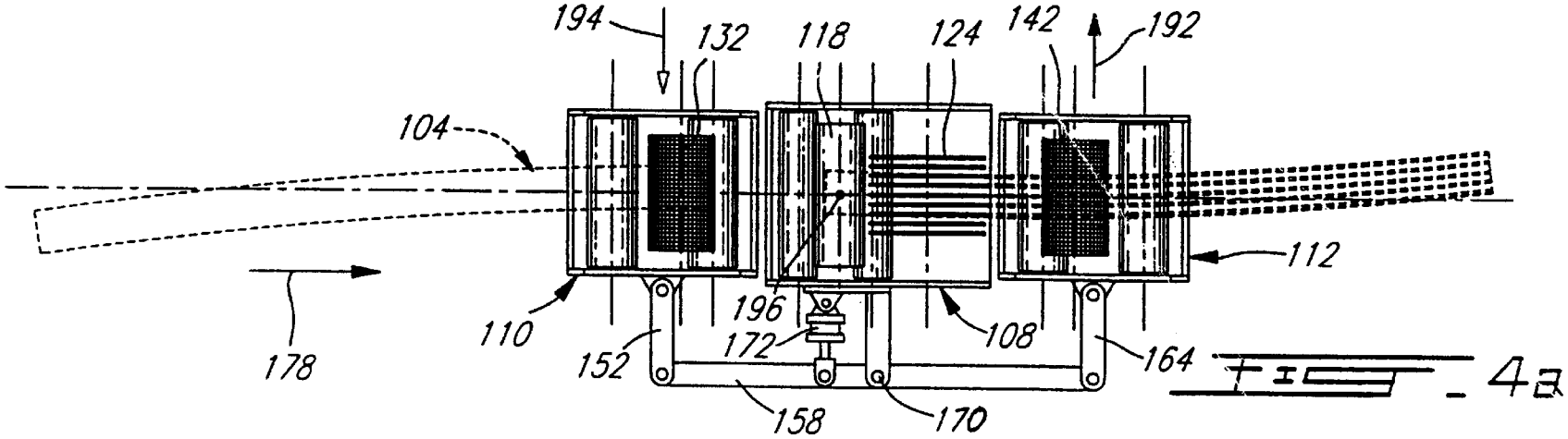
Figure 4B:
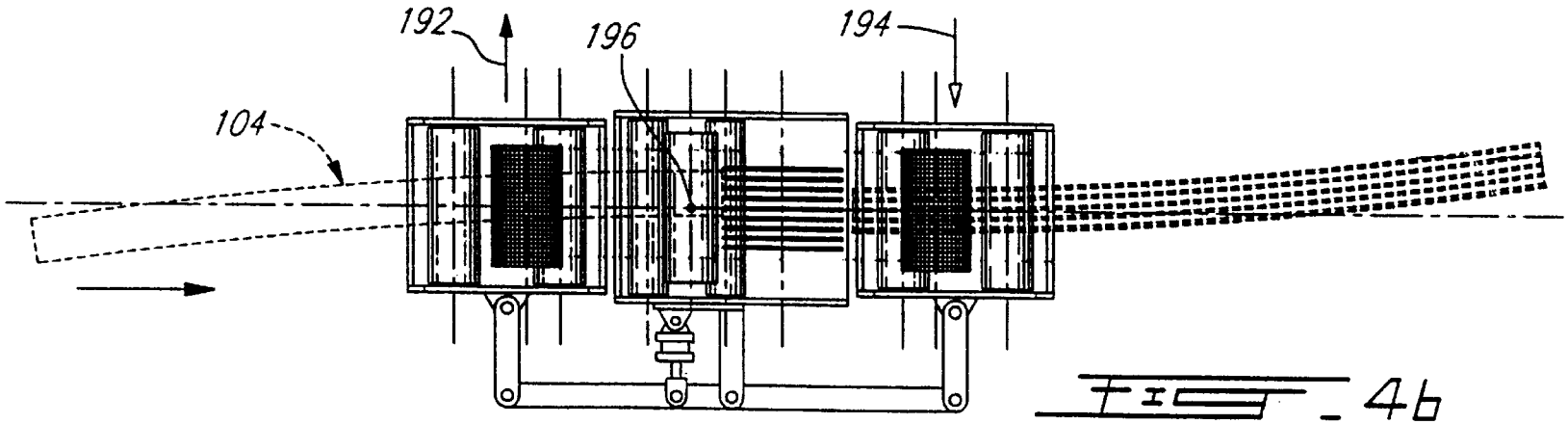
Figure 4C:
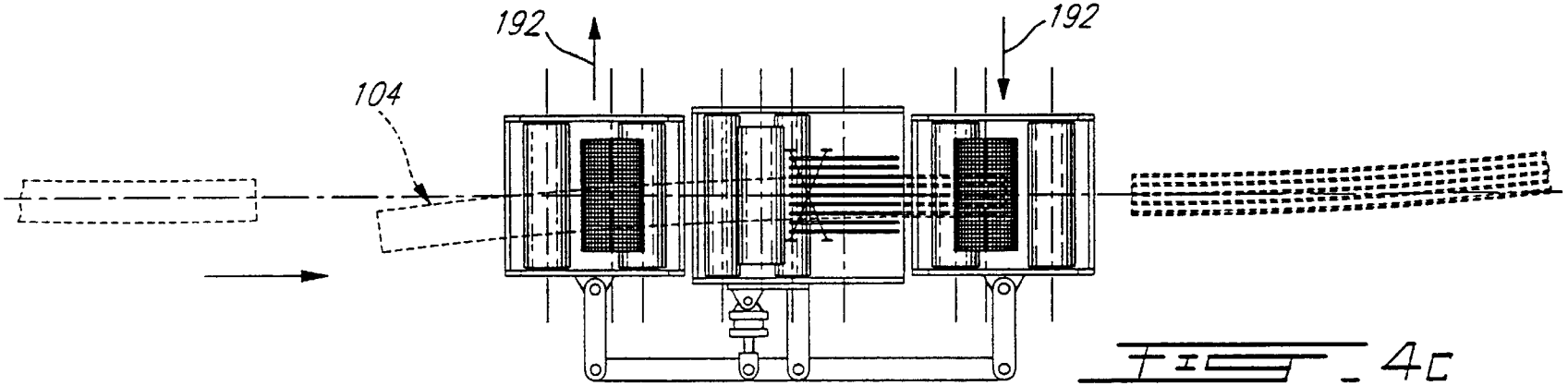
Figure 4D:
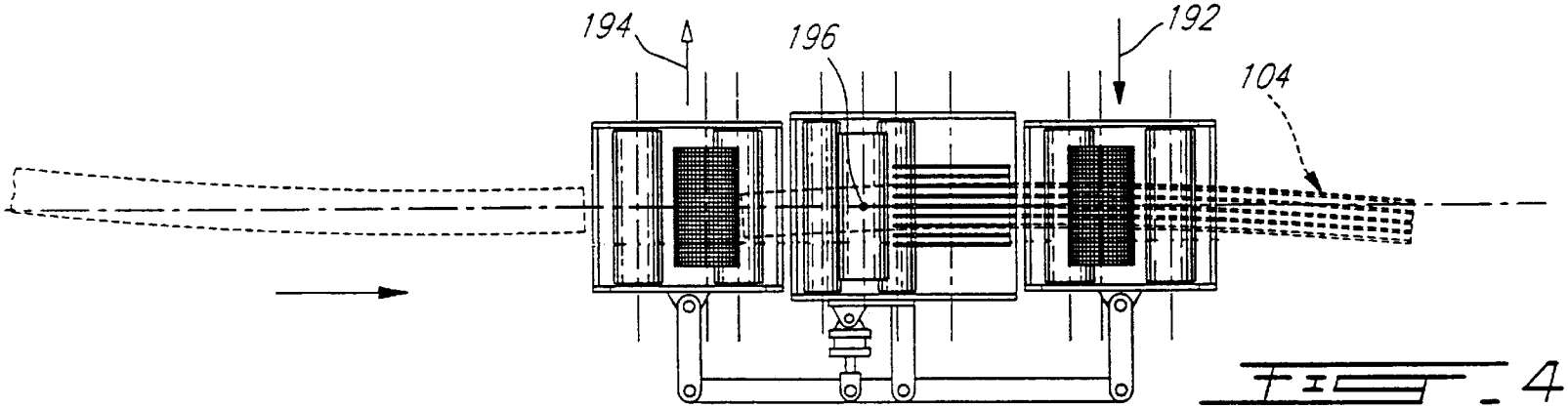
Figure 4E:
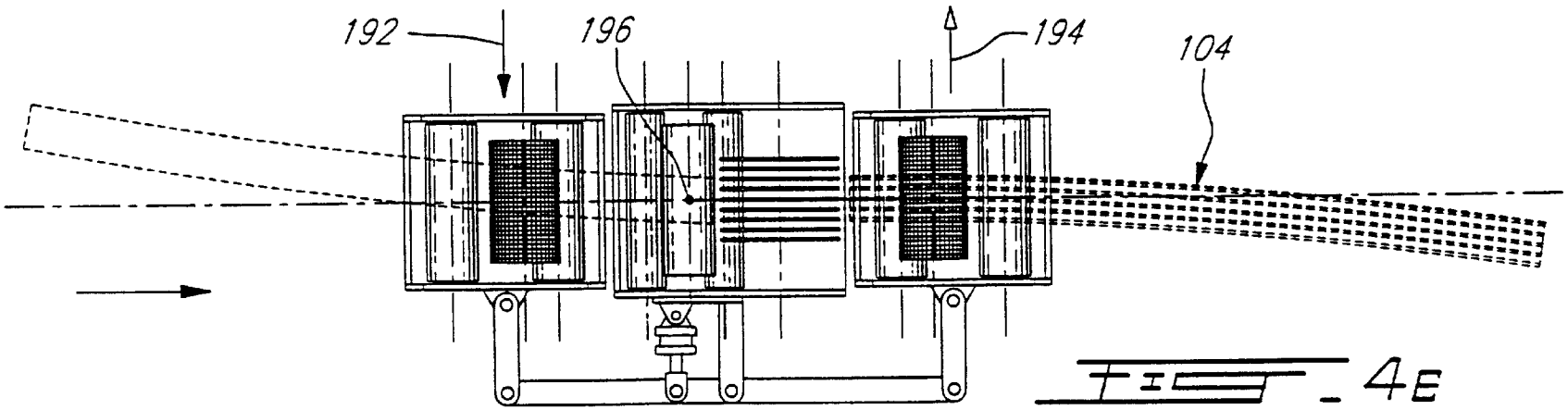

As a further illustration of the process involved in this invention, FIGS. 4*a* to 4*e* show the various phases of the cutting sequence for cant 104 passing through the system, along with other pieces in front and behind it. The symbol identification is as follows:

a) Transversal arrows indicate lateral movements of units 110 and 112. Black arrows 192 indicate that press rolls 132–142 are in contact with cant. White arrows 194 indicate that press rolls 132–142 are not in contact with cant.

b) Pressure application: Press roll 118. Black dot 196 indicates contact with cant (FIGS. 4*a*, 4*b*, 4*d*, 4*e*). No black dot indicates no contact with cant (FIG. 4*c*).

c) Black dot 196 in FIGS. 4*a*, 4*b*, 4*d*, 4*e* also indicates location of pivotal point for cant.

d) X mark in FIG. 4*c* indicates location of pivotal point for cant.

Cant 104 is shown going through right-hand curved sawing, following another piece being cut along a curve in the opposite direction. A study of the above symbol explanation in relation to FIGS. 4*a* to 4*e* will confirm that the system described permits processing cants having alternatively right and left hand curvature, while maintaining the minimum longitudinal gap required for the dimensional and form scanning process.

An alternative application of this invention in the processing of a two-faced curved cant relates to the squaring off with cutterheads 200 and 202, such as found in a chipper-canter unit 204, for subsequent resawing to lumber dimensions. This process is illustrated in FIG. 6, where the construction of the guiding units 110' and 112' is identical to that of units 110 and 112 in FIGS. 1 and 2. Hence, a detailed description of the components of each guiding unit will not be given, a prime mark having been used for their comparative identification. The basic difference between resawing and squaring with cutter heads resides in the working characteristics of saws comparatively to knife action. Basically, saws do not tolerate lateral pressures whereas cutter heads can absorb a relatively large amount of side deviation of the workpiece. Therefore, the basic necessity to provide lateral stability in the saw cut area does not apply to cutter head action, and the stationary clamping rolls 114,116 and 118 of FIGS. 1 and 2 are not required in the system shown in FIG. 6. However, because of this lateral chipping capacity of cutter heads, fixed lateral guides 230 and 232 have to be used in contact with faces 101 and 103 ultimately, said guides providing, in the case of curved cutting, a pivoting point for the cant behind the cut. In the case of curved cutting with knife type heads, the curve is initiated as the cant enters the cut longitudinally with a controlled lateral motion, inasmuch as the trailing end of it is held along a straight line by the feeding apparatus 179 in FIG. 5, until contact of the cant with fixed lateral guides 230 and 232. The curve then continues throughout the cut, with lateral guides 230 and 232 now serving as pivotal point for the cant. During this time, guiding units 110' and 112' hold the cant 104 consecutively (or jointly) while moving laterally at controlled speeds and in opposite directions, as in the case of the curve sawing system illustrated in FIGS. 1 and 2. This lateral control is supplied by an equalizing linkage similar to the one already described, and as illustrated schematically in FIG. 6. Scanner data is computer processed and used in the same manner to generate signals controlling speed and direction of movement of cylinder 172' and therefore of guiding units 110' and 112'.

A further embodiment of this invention would consist in utilizing, either for the curve sawing or the squaring off process, only one of the two guiding units, whether in front of or behind the cutting unit. In either case, the general effect on curve generation in the cut would be somewhat similar to that of the double synchronized system already described, with two important differences: in no case could the curve be performed throughout the whole length of the cut, since one or the other extremity of the cant (depending on which unit was used) would be cut while outside the guiding area; also, the fixed pivoting point provided for the cant by press roll 118 is not located for the most favorable saw orientation in the cut (see FIGS. 3*a* and 3*b*) for which cant pivoting should occur near point marked X in FIG. 4*c*, as determined by planned positioning of pivot 170 in the equalizing lever 158. It can therefore be said that in one way or another the advantages of the double synchronized guiding units would be partially lost for the whole length of a curving cut.

Other objects and further scope of applicability of the present invention can be inferred from the detailed description given herein. It should be understood, however that such description, while indicating preferred embodiments of the invention, is given by way of illustration only, since various changes and modifications within the spirit and scope of the invention will become apparent to those skilled in the art.

What is claimed is:

1. In combination with a sawing unit equipped with sawing elements for sawing two-faced cants having opposite and parallel planar faces, a curve cutting control system for directing a cant to move along a natural axis of curvature of said cant throughout a sawing process, said system comprising:

first clamping means disposed at a fixed infeed location of the sawing unit for rollingly clamping under a clamping pressure the opposite planar faces of said cant in order to provide a temporary pivotal point for said cant during an entry to and exit from said sawing elements;

a first laterally movable guiding unit including second clamping means located upstream of said first clamping means for rollingly clamping under a clamping pressure said opposite planar faces of the cant;

a second laterally movable guiding unit including third clamping means located downstream of said sawing unit for rollingly clamping under a clamping pressure said opposite planar faces of said cant;

means for releasing pressure of said first clamping means on the cant at said fixed infeed location for removing said temporary pivotal point after said cant is clamped by said second and third clamping means of said first and second guiding units;

linking means for connecting said first and second guiding units together and for providing simultaneous and opposite lateral displacements of said guiding units, said linking means fixed about a centrally disposed pivot point;

actuator means connected to said linking means, said actuator means for pivotally displacing said linking means about said pivot point, whereby said first and second guiding units are laterally displaced and opposite, lateral motions are imparted by said linking means to the cant at clamping points in said first and second guiding units, whereby said cant is free to pivot about a further pivotal point resulting from said opposite lateral motions;

scanning means located upstream of said first guiding unit for providing data on dimensions, form and position of an incoming cant to be processed through said sawing unit;

encoder means for measuring an advance of said cant towards and through the sawing unit through interpretation of said data provided by said scanning means, said encoder means emitting operating signals in a sequence corresponding to a position of the cant in the system; and data responsive means operatively connected with said scanning means. said encoder means, and said actuator means for controlling lateral displacements of said first and second guiding units in accordance with said scanned data on dimensions, form and position of said incoming cant.

2. The combination as defined in claim 1, wherein each of said first and second guiding units include respective slide means for moving said units laterally in opposite directions relative to one another.

3. The combination as defined in claim 1, wherein each of said first and second guiding units include respective means for releasing said clamping pressure on said cant.

4. The combination as defined in claim 1, wherein said data responsive means include means for analyzing data received from said scanning and encoder means and for determining speed and direction of movement for said guiding units.

5. The combination as defined in claim 4, wherein said actuator means are responsive to data analyzed by said analyzing means.

6. The combination as defined in claim 1, wherein said actuator means consist of cylinder means having one end connected to said linking means and an opposite end to said sawing unit.

7. The combination as defined in claim 1, wherein said actuator means are individually and directly connected to each of said first and second guiding units, and said actuators are synchronized and coordinated solely through said data responsive means.

8. The combination as defined in claim 1, wherein said sawing elements consist of a series of vertically extending circular saws.

* * * * *